137-13 SR

5/29/79 OR 4,156,434

United States Patent [19]

Parker et al.

[11] 4,156,434

[45] May 29, 1979

[54] LOW POUR POINT FUEL COMPOSITIONS

[75] Inventors: Levi C. Parker, Port Arthur; Kenneth D. Miller, Spring, both of Tex.

[73] Assignee: Texaco Inc., White Plains, N.Y.

[21] Appl. No.: 761,552

[22] Filed: Jan. 24, 1977

Related U.S. Application Data

[63] Continuation-in-part of Ser. No. 265,097, Jun. 21, 1972, abandoned.

[51] Int. Cl.[2] ..... C10L 1/18; F17D 1/17

[52] U.S. Cl. ..... 137/13; 44/62; 44/70; 44/61

[58] Field of Search ..... 44/62, 70; 260/878 R, 260/878 B; 137/13

[56] References Cited

U.S. PATENT DOCUMENTS

| | | | |
|---|---|---|---|
| 3,260,728 | 7/1966 | Ilnyckyj | 44/62 |
| 3,369,992 | 2/1968 | Henke et al. | 208/14 |
| 3,567,639 | 3/1971 | Aaron et al. | 44/62 |
| 3,853,497 | 12/1974 | Miller et al. | 44/62 |

FOREIGN PATENT DOCUMENTS

| | | | |
|---|---|---|---|
| 1154966 | 6/1969 | United Kingdom | 44/62 |

*Primary Examiner*—Winston A. Douglas
*Assistant Examiner*—Y. Harris-Smith
*Attorney, Agent, or Firm*—Carl G. Ries; Thomas H. Whaley; Walter D. Hunter

[57] ABSTRACT

A low-pour fuel composition is prepared by blending with a gas oil a minor amount of a high asphaltene residuum, such as an Arabian Light 1050° F. residuum, and from about 0.003 to about 0.50 weight percent of an oil-soluble copolymer which can be, for example, an ethylene-vinyl acetate copolymer or a block copolymer of the A—B—A type wherein the A block is derived from an ester of acrylic acid or methacrylic acid and an aliphatic alcohol and the B block is a copolymer of ethylene and vinyl acetate, etc.

9 Claims, No Drawings

LOW POUR POINT FUEL COMPOSITIONS

This application is a continuation-in-part of application Ser. No. 265,097, filed June 21, 1972, now abandoned.

BACKGROUND OF THE INVENTION

1. Field of the Invention

This invention is concerned with improving the flow properties and pour point characteristics of gas oils. Particularly, the invention is concerned with a fuel composition comprising a major amount of a gas oil and a minor amount of a high asphaltene residuum together with an effective pour depressant amount of, for example, an oil-soluble, high molecular weight ethylene-vinyl acetate copolymer or an oil-soluble block copolymer of the A—B—A type wherein the A block is an acrylate ester and the B block is a copolymer of ethylene and vinyl acetate. Another aspect of this invention relates to an improved pipeline transportation process for the above-described fuel compositions.

2. Description of the Prior Art

As is well known, many gas oils boiling at about 450° to about 1050° F. contain quantities of wax which render them viscous and give unacceptably high pour points. These oils behave as non-Newtonian liquids at low temperatures: exhibit variable solidifying temperature and peculiar hysteresis phenomena—all of which render them difficult to use as fuel.

One approach that could be used in converting these oils would be to subject them to fairly lengthy dewaxing procedures. This, however, would be an expensive procedure.

Another approach which has been used to bring the viscosity of the "crude" gas oils to suitable levels has been to dilute or "cut" them with a major amount of lighter distillate oils but this is an expensive procedure because of the considerably higher costs of the lighter distillate oils relative to the higher boiling oils. The distillate can be sold directly as a diesel fuel and as such is valuable and in short supply.

A number of additives have been suggested and tried with success in lubricating oils and in so-called middle distillates in order to tie in the wax therein and improve flow at low temperatures. Such additives consist either of compounds formed by alkylating benzene or naphthalene derivatives or of copolymers of ethylene-vinyl saturated aliphatic monocarboxylic acid esters of a molecular weight up to 3000 and containing from 15 to 25 percent by weight of the vinyl saturated aliphatic monocarboxylic acid ester. These additives are not, however, effective in depressing the pour point of certain fuel oil compositions.

In recent years the restrictive specifications limiting the sulfur content of fuel oils have made the manufacture of such fuels a much more difficult task than previously. In many localities, low-sulfur, high-pour fuels are being substituted for previously utilized high-sulfur, low-pour fuels. In order to meet the stringent pour point specifications of such fuel oils, pour depressants are being used. A particular effective class of pour depressants are, for example, the ethylene-vinyl acetate copolymers having molecular weights ranging from about 15,000 to about 60,000 and having and ethylene content of about 45 to about 90 percent. Although the ethylene-vinyl acetate copolymers have been shown to be effective in reducing the pour points of crudes and fuel oil blends containing distillate, they have not been found to be very effective in reducing the pour points of vacuum gas oils.

It is therefore the main object of the present invention to provide a fuel composition based on "crude" gas oils which will be free of the above-mentioned prior art limitations.

An equally important object of this invention is to provide a fuel oil composition having improved pour point characteristics by incorporating therein a minor amount of residuum and a small amount of certain highly effective pour depressants.

BRIEF DESCRIPTION OF THE INVENTION

The fuel oil compositions of this invention comprise a major amount of a gas oil or gas oils boiling at about 450° to about 1050° F., a minor amount (i.e., less than 15 percent by weight of a high asphaltene residuum) and an effective pour depressant amount of an oil-soluble copolymer selected from the group consisting of:

A. an ethylene-vinyl acetate copolymer having a number average molecular weight between about 17,000 and about 30,000 and a vinyl acetate content of about 10 to about 45 weight percent with the balance being ethylene;

B. an A—B—A block copolymer wherein the A block is derived from an ester of an acrylic or methacrylic acid with a monohydric saturated aliphatic alcohol of the formula:

R—OH, wherein R is straight chain or branched alkyl of from 12 to about 24 carbon atoms, the B block is a copolymer of ethylene and vinyl acetate, wherein the number average molecular weight of the said copolymer is about 15,000 to about 35,000, wherein the weight percent of vinyl acetate in the said block copolymer is about 8 to 25 weight percent, the weight percent of the said ester of acrylic or methacrylic acid in the said block copolymer is about 3 to about 15 weight percent with the balance being ethylene; and C. a heteric copolymer of ethylene, vinyl acetate and an ester of acrylic or methacrylic acid with a monohydric aliphatic alcohol of the formula:

R—OH, wherein R is straight chain or branched alkyl of from 12 to about 24 carbon atoms, wherein the number average molecular weight of the said copolymer is about 12,000 to about 37,000 and the weight percent of the ethylene, vinyl acetate and ester or acrylic or methacrylic acid is the same as in copolymer B. In another aspect, this invention relates to a process for the pipeline transportation of the above-mentioned fuel oil compositions. Surprisingly, it has been found that the addition of a minor amount of a high asphaltene residuum together with a small amount of either of the pour depressants mentioned above and mixtures thereof yields a fuel oil composition of substantially lowered pour point.

DETAILED DESCRIPTION OF THE INVENTION

Ethylene-vinyl acetate useful in preparing the novel fuel compositions of this invention include those materials having number average molecular weights ranging from about 17,000 to about 30,000 in which the vinyl acetate content is about 10 to about 45 weight percent.

The copolymers may be prepared by any convenient process, such as that of U.S. Pat. Nos. 3,048,479 and 3,215,678, by a free radical-initiated polymerization of ethylene and a vinyl acetate. An especially useful group of ethylene-vinyl acetate copolymers are those manufactured by E. I. duPont de Nemours and sold under the tradename "Elvax". The characteristics of the various Elvax additives are given in Table I below:

TABLE I

| "ELVAX" | % Vinyl Acetate in Copolymer | Melt Index* |
|---|---|---|
| 40 | 39–42 | 45–70 |
| 150 | 32–34 | 22–28 |
| 210 | 27–29 | 335–465 |
| 220 | 27–29 | 125–175 |
| 240 | 27–29 | 22–28 |
| 250 | 27–29 | 12–18 |
| 260 | 27–29 | 5–7 |
| 310 | 24–26 | 335–465 |
| 350 | 24–26 | 16–22 |
| 360 | 24–26 | 1.6–2.4 |
| 410 | 17–19 | 430–580 |
| 460 | 17–19 | 2.1–2.9 |

*in g/10 min. as determined by ASTM 1328 modified.

In preparing the ethylene-vinyl acetate copolymers generally the polymerization is conducted at temperatures of about 280° to about 340° F. and at pressures ranging from about 700 to about 2000 psig and, preferably, at about 750 to about 950 psig. The autoclave employed containing the solvent such as benzene, toluene, etc. and the vinyl acetate is first purged about three times with nitrogen, twice with ethylene and then charged with sufficient ethylene to give the desired pressure when heated to the reaction temperature. Additional ethylene is added as the polymerization procedes whenever it is needed. Generally the polymerization is considered to be complete when the pressure of the autoclave drops to less than about 60 psig. The solid copolymer is recovered by stripping off the solvent and any unreacted vinyl acetate which remains under vacuum.

A modified ethylene-vinyl acetate copolymer which is highly useful in some gas oil compositions of this invention is a heteric copolymer which contains from about 0.5 to 1.5 percent by weight of N-vinyl-2-pyrrolidone and about 10 to about 40 weight percent of vinyl acetate with the balance being ethylene and with all percentages being based on the total weight of the copolymer. Useful modified copolymers of this type which can be prepared in the same manner as previously described, will have molecular weights of about 17,000 to about 30,000 or more.

Block copolymers of A—B—A type where the A block is derived from an ester of acrylic acid or methacrylic acid with a monohydric saturated aliphatic alcohol of the formula:

R—OH, wherein R is straight chain or branched alkyl having from 12 to about 24 carbon atoms and the B block is a copolymer of ethylene and vinyl acetate or a modified copolymer of ethylene and vinyl acetate which contains a small amount of copolymerized N-vinyl-2-pyrrolidone in random or heteric arrangement can be made, for example, by redissolving an ethylene-vinyl acetate copolymer or a modified ethylene-vinyl acetate copolymer prepared as described above, in benzene or other suitable hydrocarbon solvent, placing the copolymer solution in a stirred autoclave with the requisite amount of acrylate or methacrylate ester together with a peroxide type catalyst and continuing the polymerization under the influence of heat and pressure. Temperatures of from about 250° to about 400° F. may be employed at autogenous pressure.

Another type of copolymers which is highly useful as a pour depressant in the gas oils of this invention are heteric copolymers of ethylene, vinyl acetate and an ester of acrylic acid or methacrylic with a monohydric aliphatic alcohol of the formula:

R—OH, wherein R is straight chain or branched alkyl of from 12 to about 24 carbon atoms having number average molecular weights of about 12,000 to about 37,000. The weight percent of vinyl acetate in such a copolymer will be from about 8 to about 25 while the weight percent of the ester of acrylic or methacrylic acid will be about 3 to 15 with the balance being ethylene.

Additional information as to the preparation of polymers of the various types set out above is disclosed in U.S. Pat. Nos. 3,048,499; 3,250,599; 3,260,728 and in 3,455,205 which are incorporated herein in their entirety.

The novel fuel compositions of this invention can be prepared in a variety of ways. For example, the residuum can be admixed with the starting gas oil or gas oils and the copolymer can be added with mixing as a solution in toluene, xylene or in the gas oil itself. Generally, the residuum and gas oil are heated to a temperature of about 175° to 300° F. and preferably at 175° to 250° F. prior to the addition of the copolymer added as 1 to 15 weight percent solution in toluene, xylene, light cycle oil, cutter stock, etc. following which the resulting mixture is heated at a temperature of about 175° to 300° F. and preferably 175° to 250° F. for about 0.2 to 1.5 hours or more to insure complete solution of the copolymer in the blend.

The gas oil fuels utilized in this invention generally will boil between 450° and 1050° F. Typical of the gas oils which may be employed are Desulfurized Arabian Light Vacuum Gas Oil (DS Arabian Lt. VGO), Desulfurized Lago Medio Vacuum Gas Oil (DS Lago Medio VGO), Arabian Light Vacuum Gas oil (Arabian Lt. VGO), Lago Medio Vacuum Gas oil (Lago Medio VGO), Amna Vacuum Gas Oil, etc., whose physical properties are set out in Table 2 which follows:

TABLE 2

| | Amna Vacuum Gas Oil | Desulfurized Arabian Light Vac. Gas Oil | Desulfurized Lago Medio Vac. Gas Oil | Lago Medio Vac. Gas Oil | Arabian Light Vac. Gas Oil |
|---|---|---|---|---|---|
| Boiling Range | 650°–900° F. | 650°–1050° F. | 650°–1050° F. | 450°–1050° F. | 650°–1050° F. |
| Pour Point, °F.(ASTM D-97) | +95 | +90 | +90 | +90 | +95 |
| Sulfur, wt. percent | 0.30 | 0.23 | 0.16 | 1.4 | 2.6 |
| Wax Content, wt. percent | 17.3 | | | | |
| Kinematic viscosity at 122° F. CS | 11.5 | 37.2 | 27.0 | | |

TABLE 2-continued

| | Amna Vacuum Gas Oil | Desulfurized Arabian Light Vac. Gas Oil | Desulfurized Lago Medio Vac. Gas Oil | Lago Medio Vac. Gas Oil | Arabian Light Vac. Gas Oil |
|---|---|---|---|---|---|
| Kinematic viscosity at 130° F. CS | | | | 16.2 | 58.0 |
| API Gravity, ° at 60° F. | 32.6 | 25.5 | 28.1 | 27.0 | 20.0 |
| Gas Oil Distillation, °F. | | | | | |
| IBP-5% | −587° | | | 453°-538° | 681°-749° |
| 10-20 | 636°-698° | | | 586°-642° | 773°-804° |
| 30-40 | 708°-734° | | | 689°-743° | 825°-848° |
| 50 | 750° | | | 778° | 868°+ |
| 60-70 | 771°-796° | | | 810°-855° | |
| 80-90 | 823°-858° | | | 882°+ | |
| 95-EP | 876°-899° | | | | |

All four points referred to throughout this specification were determined by the method of ASTM-D-97.

This invention is especially useful for preparing low-pour fuel oil compositions utilizing desulfurized gas oils. The desulfurized vacuum gas oils were prepared by hydrotreating the raw vacuum gas oils over 1/16" Aero HDS-1441 catalyst (Cobalt-molybdenum on silica-alumina). Nominal operating conditions used in preparing the DS Arabian Light VGO were 750° F. average catalyst bed temperature, 1 LHSV, 2000 SCF $H_2$/barrel and 790 psig total reactor pressure. Nominal operating conditions for the Lago Medio VGO run were 730° F. average catalyst bed temperature, 2 LHSV, 2000 SCF $H_2$/barrel and 890 psig total reactor pressure. The raw Lago Medio VGO had a high quantity (23.1%) of material boiling below 650° F. The total product from the desulfurization runs was fractionated on packed glass columns to remove 650° F. and lighter components.

High asphaltene residua stocks suitable for use in the fuel oil compositions of this invention include a wide variety of residual fuel oil bottoms such as Arabian Light (650° F.+ or greater) residuum, Lago Medio (650° F.+ or greater), a thermally cracked heavy fraction of Amna Crude (650° F.+ or greater), and thermal cycle fuel oil from various crude sources. Preferably, the residua stocks employed will have an asphaltene content of about 4 to about 15 weight percent and a carbon residue of about 5 to about 25 weight percent.

Although the amount of residuum included in the fuel oil compositions of this invention can be varied over a wide range the maximum amount which can be utilized is about 20 weight percent and preferably will be from about 1 to about 15 weight percent based on the weight of the composition.

Physical properties of typical residua stocks which may be utilized in the novel compositions of this invention are set forth in Table 3 below:

TABLE 3

| | Tests on Residua Stocks | | | | |
|---|---|---|---|---|---|
| | PAP Thermal Cycle Fuel Oil | 1050° F.+ Lago Medio Resid. | 900° F.+ Amna Resid. | 1050° F.+ Arab Lt. Resid. | Cracked 950° F. Amna Crude |
| Pour Point, °F. | +35 | 120+ | 120+ | 120+ | +70 |
| Sulfur, wt percent | 0.87 | 2.8 | 0.31 | 3.2 | 0.29 |
| Vis. Kin, cs at 122° F. | 392 | — | — | — | — |
| Vis. Kin cs at 210° F. | 46.2 | 1700 | 23.9 at 300° F. | 469 | — |
| API Gravity, at 60° F. | 8.0 | 9.8 | 14.8 | 9.2 | — |
| Carbon Residue, wt. % | — | 20.4 | 17.5 | 17.1 | — |
| Asphaltenes Basis N—$C_5$ Insolubles, Wt. % | — | 12 | 9 | 9 | — |

It will be evident to those skilled in this art that the pour point depressants of this invention may be used along with other additives usually found in fuel oils of the character described. Such other additives will include rust inhibitors, anti-emulsifying agents, anti-static agents, anti-oxidants and the like.

The following examples illustrate various embodiments of the invention and are to be considered not limitative.

EXAMPLE I

The effect of the addition of varying amounts of Elvax 250 copolymer to Desulfurized Arabian Light VGO and Desulfurized Lago Medio VGO was demonstrated in this example, The results which are reported in Table 4 show that the added pour depressant is not effective in reducing the pour points of the desulfurized vacuum gas oil base stocks.

TABLE 4

| Effect of Pour Depressant on Desulfurized Vacuum Gas Oils | | | | | | | | |
|---|---|---|---|---|---|---|---|---|
| | Arabian Light | | | | Lago Medio | | | |
| Run No. | 1 | 2 | 3 | 4 | 5 | 6 | 7 | 8 |
| Elvax 250, wt. % | None | 0.025 | 0.05 | 0.10 | None | 0.025 | 0.05 | 0.10 |
| Test Results | | | | | | | | |
| Viscosity, 122° F., CS | 37.02 | | | | | | | |
| Viscosity, 210° F., CS | 7.79 | | | | 6.27 | | | |
| ASTM Upper Pour, °F. | +80 | +75 | +70 | +60 | +80 | +80 | +75 | +85 |
| Storage Data | | | | | | | | |
| ASTM Upper Pour, °F. 1 month, at 90° F. | +90 | +80 | +75 | +70 | +90 | +75 | +80 | +80 |

TABLE 4-continued

| Effect of Pour Depressant on Desulfurized Vacuum Gas Oils | | | | | | | | |
|---|---|---|---|---|---|---|---|---|
| | Arabian Light | | | | Lago Medio | | | |
| Run No. | 1 | 2 | 3 | 4 | 5 | 6 | 7 | 8 |
| 1 month, at 115° F. | — | +80 | +80 | +80 | — | +75 | +70 | +75 |

EXAMPLE II

A series of blends were prepared using Desulfurized Arabian Light VGO and Arabian Light 1050° F.+ residuum by mixing the two components at 200° F. for 30 minutes. Varying amounts of Elvax 250 copolymer were then added with mixing. Data relating to the blends and the resulting pour points thereof are found in Table 5.

The outstanding reductions in pour points as well as the synergistic action achieved through the addition of both the copolymer and residuum exhibited by these blends are shown in Runs 3 and 4. The maximum pour points shown in this example and later examples were obtained by heating the oil at 220° F. for 3 hours, followed by cooling to approximately room temperature. The sample was then immediately cooled to 0° F. for a minimum of 12 hours. Following this treatment, the pour point of the oil is determined by ASTM method D-97. The maximum pour point procedure is designed to give a quick indication of the pour point storage stability of the fuel oil.

TABLE 5

| Effect of Pour Depressant on Blend of Desulfurized Arabian Light Vacuum Gas Oil with Arabian Light 1050° F.+ Residuum | | | |
|---|---|---|---|
| Wt. % Arabian Lt. Resid. | | 10.0 | |
| Wt. % DS Arabian Lt. VGO | | 90.0 | |
| Run No. | 1 | 2 | 3 |
| Elvax 250, wt. % | None | 0.025 | 0.10 |
| Test Results | | | |
| Visc. 122° F., CS | 59.57 | | |
| Visc. 210° F., CS | 10.28 | | |
| ASTM Upper Pour, °F. | +95 | +85 | −5 |
| Maximum Pour Point, °F. | +95 | +85 | +5 |
| Storage Data | | | |
| ASTM Upper Pour °F. | | | |
| 1 month at 90° F. | +90 | — | −10 |
| 1 month at 115° F. | +80 | +75 | −10 |

EXAMPLE III

Blends are prepared by mixing Desulfurized Lago Medio Vacuum Gas Oil and Lago Medio 1050° F.+ Residuum together at 220° F. (with mixing) for 40 minutes and with varying amounts of an oil-soluble, block copolymer of the A—B—A type in which the A blocks are derived from octadecyl acrylate and the B block is a copolymer of ethylene and vinyl acetate having a number average molecular weight of about 23,000 (Copolymer G). The weight percent of vinyl acetate in Copolymer G based on the total weight of the copolymer is 9.5; the weight percent of the octadecyl acrylate is 16.2 with the balance of the copolymer being ethylene. The upper pour point of the above-described blend with no added Copolymer G was determined according to the method of ASTM D-97 and found to be +80° F. which is the same pour point as Desulfurized Lago Medio VGO alone whereas the upper pour point of this same blend containing 0.10 weight percent Copolymer G is found to be substantially below +80° F. when determined by the same ASTM method.

EXAMPLE IV

In this example, blends were prepared employing Desulfurized Arabian Light Vacuum Gas Oil, Arabian Light 1050° F. Residuum and with and without small amounts of a heteric copolymer of hexadecyl methacrylate (4.1 weight percent), vinyl acetate (10.3 weight percent) with the balance being ethylene (Copolymer F) by mixing all components for 30 minutes at 205° F. In this example the copolymer was added as a 5 weight percent solution in toluene. The number average molecular weight of this copolymer is about 29,800. The pour points of the blends is then determined according to the method of ASTM D-97. Data for Blends I and II which consisted only of mixtures of Desulfurized Arabian Light Vacuum Gas Oil is set out in Table 6 which follows. Blend III which was identical to Blend I except that it contained 0.1 weight percent of Copolymer F and Blend IV which was identical to Blend II except that it contained 0.15 weight percent of Copolymer F are then prepared in the same manner as previously described. The upper pour points of Blends III and IV are then measured using the same procedure as employed for Blends I and II and the pour point of Blend III is found to be substantially below the pour point for Blend I and the pour point for Blend IV is found to be substantially below that of Blend II.

TABLE 6

| Blends Containing Arabian Light Desulfurized VGO and Arabian Light 1050° F.+ Residuum | | |
|---|---|---|
| | Blend I | Blend 11 |
| Components, Wt. % | | |
| Arabian Lt. DS VGO | 95.0 | 98.0 |
| Arabian Lt. 1050° F.+ Residuum | 5.0 | 2.0 |
| Test Results | | |
| Viscosity, 210° F., CS | 8.97 | 8.37 |
| ASTM Upper Pour, °F. | +90 | +95 |
| Maximum Pour, °F. | +90 | +95 |

What is claimed is:

1. A fuel oil composition comprising a major amount of a gas oil boiling between 450° and 1050° F., a minor amount of a high asphaltene residuum and an effective pour depressant amount of an oil-soluble copolymer selected from the group consisting of:

a. an A—B—A block copolymer wherein the A block is derived from an ester of an acrylic or methacrylic acid with a monohydric saturated aliphatic alcohol of the formula:

R—OH, wherein R is straight chain or branched alkyl of from 12 to about 24 carbon atoms, the B block is a copolymer of ethylene and vinyl acetate, wherein the number average molecular weight of the said copolymer is about 15,000 to about 35,000, wherein the weight percent of vinyl acetate in the said block copolymer is about 8 to 25 weight percent, the weight percent of the said ester of acrylic or methacrylic acid in the said block copolymer is about 3 to about 15 weight percent with the balance being ethylene; and b. a heteric copolymer of ethylene, vinyl acetate and an ester of acrylic or methacrylic acid with a monohydric aliphatic alcohol of the formula:

R—OH, wherein R is straight chain or branched alkyl of from 12 to about 24 carbon atoms, wherein the number average molecular weight of the said copolymer is about 12,000 to about 37,000 and the weight percent of the ethylene, vinyl acetate and ester of acrylic or methacrylic acid is the same as in copolymer a.

2. The fuel oil composition of claim 1 wherein the amount of residuum is about 1 to about 15 weight percent.

3. The fuel oil composition of claim 1 wherein the said residuum has an asphaltene content of about 1 to about 15 weight percent and a carbon residue of about 5 to about 25 weight percent.

4. The fuel oil composition of claim 1 wherein the said oil-soluble copolymer is present in an amount equal to about 0.003 to about 0.5 weight percent of the said composition.

5. The fuel oil composition of claim 1 wherein the said oil-soluble copolymer utilized is an A—B—A block copolymer wherein the A block is derived from an ester of an acrylic or methacrylic acid with a monohydric saturated aliphatic alcohol of the formula:

R—OH, wherein R is straight chain or branched alkyl of from 12 to about 24 carbon atoms, the B block is a copolymer of ethylene and vinyl acetate, wherein the number average molecular weight of the said copolymer is about 15,000 to about 35,000, wherein the weight percent of vinyl acetate in the said block copolymer is about 8 to 25 weight percent, the weight percent of the said ester of acrylic or methacrylic acid in the said block copolymer is about 3 to about 15 weight percent with the balance being ethylene.

6. The fuel oil composition of claim 1 wherein the said oil-soluble copolymer utilized is a heteric copolymer of ethylene, vinyl acetate and an ester of acrylic or methacrylic acid with a monohydric aliphatic alcohol of the formula:

R—OH, wherein R is straight chain or branched alkyl of from 12 to about 24 carbon atoms, wherein the number average molecular weight of the said copolymer is about 12,000 to about 37,000 and the weight percent of the ethylene, vinyl acetate and ester of acrylic or methacrylic acid is the same as in copolymer B.

7. In the transportation of viscous fuel oils the improvement which comprises introducing into the said pipeline a fuel oil composition comprising a major amount of a gas oil boiling between 450° and 1050° F., a minor amount of a high asphaltene residuum and an effective pour depressant amount of an oil-soluble copolymer selected from the group consisting of:

a. an A—B—A block copolymer wherein the A block is derived from an ester of an acrylic or methacrylic acid with a monohydric saturated aliphatic alcohol of the formula:

R—OH, wherein R is straight chain or branched alkyl of from 12 to about 24 carbon atoms, the B block is a copolymer of ethylene and vinyl acetate, wherein the number average molecular weight of the said copolymer is about 15,000 to about 35,000, wherein the weight percent of vinyl acetate in the said block copolymer is about 8 to 25 weight percent, the weight percent of the said ester acrylic or methacrylic acid in the said block copolymer is about 3 to about 15 weight percent with the balance being ethylene; and b. a heteric copolymer of ethylene, vinyl acetate and an ester of acrylic or methacrylic acid with a monohydric aliphatic alcohol of the formula:

R—OH, wherein R is straight chain or branched alkyl of from 12 to about 24 carbon atoms, wherein the number average molecular weight of the said copolymer is about 12,000 to about 37,000 and the weight percent of the ethylene, vinyl acetate and ester of acrylic or methacrylic acid is the same as in copolymer a.

8. The method of claim 7 wherein the amount of residuum in said fuel oil composition is about 1 to about 15 weight percent.

9. The method of claim 7 wherein the said residuum has an asphaltene content of about 1 to about 15 weight percent and a carbon residue of about 5 to about 25 weight percent.

* * * * *